United States Patent [19]

Givler

[11] Patent Number: 4,829,281

[45] Date of Patent: May 9, 1989

[54] THERMOSTATIC SWITCH HAVING A BIMETAL STRIP WITH INCREASED LIFE EXPECTANCY

[75] Inventor: Omar Givler, North Canton, Ohio

[73] Assignee: Portage Electric Products, Inc., North Canton, Ohio

[21] Appl. No.: 239,931

[22] Filed: Sep. 2, 1988

[51] Int. Cl.[4] ..... H01H 37/04; H01H 61/08

[52] U.S. Cl. ..... 337/372; 337/113; 337/368

[58] Field of Search ..... 337/372, 368, 113

[56] References Cited

U.S. PATENT DOCUMENTS 4,755,787 7/1988 Wehl ..... 337/372

*Primary Examiner*—H. Broome

*Attorney, Agent, or Firm*—McAulay, Fields, Fisher, Goldstein & Nissen

[57] ABSTRACT

The present invention provides an improved means of connecting the end of a bimetal blade, from which the bimetal flexes, to a planar member of a thermostatic switch. The bimetal blade, in response to temperature changes of the ambient, flexes to alternately establish circuit closed and open conditions of the switch. In a preferred embodiment, the planar member is a contact strip that overlies the basewall of a non-conducting case. The attachment provided by the present invention increases the cyclical life expectancy of the bimetal blade by locating a preloaded weld button against the one attached end of the bimetal blade in a press fit wherein a pressure, exerted by the weld button, prevents movement of the bimetal blade. A weld penetrates the planar member, the bimetal blade and the weld button to prevent relaxation of the pressure. In the connection of the present invention, the blade is held in place essentially by the pressure exerted by the weld button rather than by the weld itself.

4 Claims, 1 Drawing Sheet

FIG. 1
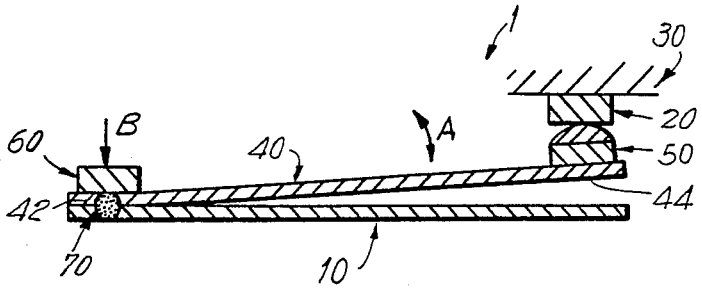
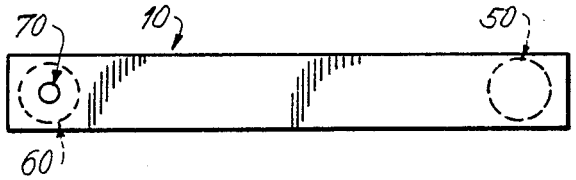
FIG. 2

THERMOSTATIC SWITCH HAVING A BIMETAL STRIP WITH INCREASED LIFE EXPECTANCY

FIELD OF THE INVENTION

The present invention relates to a thermostatic switch having a bimetal blade that flexes from an attached end of the blade to open and close a contact set. Even more particularly, the present invention relates to the thermostatic switch in which the attached end of the blade is connected to a planar member of the switch by a preloaded weld button exerting a pressure against the attached end of the blade to hold the blade in place and a weld penetrating the planar member, the bimetal blade and the weld button to prevent the relaxation of the pressure.

BACKGROUND OF THE INVENTION

Thermostatic switches have long been used to protect motors, generators, transformers and like electrical components by breaking contact between the component and the power supply during an elevated ambient temperature and by re-establishing contact between the component and the power supply after the ambient temperature has cooled to a safe level. Although there are many different prior art switch designs, the switch design of concern generally can be be said to include a fixed contact mounted so as to face towards a planar member of the switch, and an elongated, electrically conductive bimetal blade, connected, at one of its ends, to the planar member with the other of its ends freely extending towards the fixed contact. Contact is made and broken, within the switch, by a movable contact, connected to the freely extending end of the bimetal blade, and the fixed contact. The bimetal blade flexes from its attached end, in response to a temperature change from the ambient, between an unstressed and undeformed state and a stressed and deformed state. In one such state, the movable contact is spaced from the fixed contact and in the other such state, the movable contact is located against the fixed contact to respectively establish circuit open and closed conditions of the switch.

A specific example of a prior art thermostatic switch, that incorporates the structure generally described above, is one in which the fixed contact and the bimetal blade are respectively mounted on a pair of contact strips that are in turn mounted in a non-conductive case with the strips insulated from one another. In such a switch design, the planar member is the contact strip that mounts the bimetal blade. Another example of a switch is one in which the blade is mounted on the basewall of an electrically conductive can and the fixed contact is mounted on an electrically conductive lid that is insulated from the can. In this type of switch design the planar member is the basewall of the conductive can. These two specific examples of thermostatic switch designs, while common, are by no means exhaustive of all prior art designs of a thermostatic switch. It is understood that these examples are mentioned for exemplary purposes and are not intended to limit the scope of applicability of the present invention.

A common method of attaching the end of the bimetal blade to the planar member, in any of the switch designs described above, as well as other switch designs that are well known in the art, is by means of a weld button and a series of tack welds that penetrate the planar member, the bimetal blade and the weld button.

In a switch design that incorporates a non-conductive case, the tack welds penetrate one of the contact strips, the bimetal blade and the weld button. After the welding process is completed, the contact strip carrying the bimetal blade, is installed in the case with the basewall of the case underlying the contact strip. In most, if not all prior art switch designs, the tack welds form a circular pattern that extends around the periphery of the weld button. As can be appreciated, the rise and fall of the ambient temperature and the consequent flexure of the bimetal blade, induces residual stresses to build up in the bimetal blade until the blade fails. Since the blade flexes from its attached end, failure normally occurs in the blade at the tack welds. Depending upon the actual design of the blade, this failure can occur between about 8,000 and 30,000 cycles of flexure. The purpose of the circular pattern of tack welds is to solidly attach the bimetal blade to the planar member and to thereby reduce the build up of residual stresses in the end of the bimetal blade. It has been found, however, by the inventor herein, that the tack welds crimp the blade, and as such, act as stress intensification sites. Thus, rather than reducing the build up of residual stresses, the pattern of tack welds increases the build up of residual stresses in the bimetal blade.

In accordance with the improvement of the present invention, a weld button and a weld are used in the connection of the bimetal blade to the planar member. However, in the present invention, unlike the prior art, the weld button is preloaded by a preload force so that the weld button bears against the attached end of the blade with a pressure that holds the blade in place. The weld penetrates the planar member, the weld button and the blade. The purpose of the weld is, however, to prevent relaxation of the pressure rather than, as in the prior art, to attach the bimetal blade to the planar member. As such, the weld is configured, in a manner well known in the art, to be strong enough to prevent relaxation of the pressure after removal of the preload force. Therefore, the blade is attached to the planar member essentially by the preloaded weld button instead of the weld. Although after repeated cycles of operation, the bimetal deforms at the specific point of the weld, the creation of a large, circular weakened area produced by the circular pattern of tack welds is therefore avoided. Thus, while it would be expected that a single weld would increase the stress intensification, the small area presented by the single weld, combined with the preloaded weld button actually reduces the build up of residual stress and increases the cyclical life expectancy of the blade. In this regard, it has been found the diameter of the weld should preferably be no more than $\frac{1}{3}$ of the diameter of the weld button. Employing the type of attachment described herein the life of the bimetal blade can be extended to about 100,000 cycles. Experimentally, a blade attached in accordance with the present invention failed after about 1,750,000 cycles of flexure.

SUMMARY OF THE INVENTION

The present invention is applied in a thermostatic switch of the type that comprises a planar member, a fixed contact spaced from the planar member, an elongated electrically conductive bimetal blade and a movable contact. Means are provided for mounting the planar member and the fixed contact so that the fixed contact faces towards the planar member. Means are also provided for connecting the bimetal blade, at one of its ends, to the planar member with the other of its ends freely extending towards the fixed contact. The movable contact is connected to the other freely extending end of the bimetal blade so as to face towards the fixed contact. The bimetal blade is adapted to flex from its one attached end, in response to a temperature change of the ambient, between an unstressed and undeformed state and a stressed and deformed state. In one such state, the movable contact is spaced from the fixed contact and in the other such state the movable contact is located against the fixed contact to respectively establish circuit open and closed conditions of the switch.

The improvement of the present invention is in the connection utilized to attach the one end of the bimetal blade to the planar member. In accordance with the improvement of the present invention, a preloaded weld button bears against the one end of the bimetal blade in a press fit wherein the pressure exerted by the weld button prevents movement of the one end of the bimetal blade relative to the weld button and to the planar member to hold the blade in place. A weld penetrates the planar member, the bimetal blade and the center of the weld button and is configured to prevent relaxation of the pressure exerted by the weld button. The weld has cross-sectional area that is less than the area of the bearing surface of the weld button. As a result, the one end of the bimetal blade is attached to the planar member essentially by the pressure exerted by the weld button rather than by the weld itself.

DESCRIPTION OF THE DRAWINGS

In the accompanying drawings:

FIG. 1 is a schematic, cross-sectional, elevational view of a thermostatic switch incorporating the improved connection of the present invention.

FIG. 2 is a schematic bottom plan view of a contact strip of a thermostatic switch incorporating the improved connection of the present invention.

DETAILED DESCRIPTION

With reference to FIG. 1, a thermostatic switch 1 is schematically illustrated that incorporates the improvement of the present invention for connecting a bimetal blade to a planar member of the switch 1. Switch 1 is illustrated as including a planar member 10, which can be a contact strip, and a fixed contact 20 spaced from the planar member 10. A component 30 of the switch 1, which can be another contact strip, is provided for mounting the fixed contact 20 so that fixed contact 20 faces towards the planar member 10. In accordance with the previous discussion, relating to the various types of prior art switch designs, the planar member 10, could alternatively be the basewall of an electrically conductive can. An elongated electrically conductive bimetal blade 40 is connected, at end 42, to the planar member 10 with the end 42 contacting the planar member 10 on one side of the blade. The other end 44 of the blade 40 freely extends towards the fixed contact 20. A movable contact 50 is connected to the end 44 of the blade 40 so as to face towards the fixed contact 20.

As could be appreciated by those skilled in the art, FIG. 1 illustrates a thermostatic switch in which the bimetal blade 40 is in an unstressed and undeformed state with the contact 50 located against the fixed contact 20 to establish a circuit closed condition of the switch. As could also be appreciated, in response to an elevated ambient temperature, the blade 40 would assume a stressed and deformed state in which the movable contact 50 would be spaced from the fixed contact 20 to establish a circuit open condition of the switch 1. After a sufficient cooling of the ambient temperature, the bimetal blade 40 would revert to its undeformed and unstressed state illustrated in FIG. 1. Although not illustrated, the blade 40 could incorporate a well known dished or cup-like depression to impart a snap action to the flexure of the blade 40. The flexure of the bimetal blade is generally indicated by a double headed arrow A.

The bimetal blade 40 is connected to the planar member 10 by the preferred means of a preloaded weld button 60 and a weld 70. The weld button 60 is located against the end 42 of the bimetal blade 40 in a press fit wherein the weld button 60 bears against the blade with a pressure that prevents movement of the end 42 relative to the weld button 60 and the planar member 10. The pressure exerted by the weld button 60 arises from the fact that the weld button 60 is "preloaded", or in other words is subjected to a preload force, indicated herein by arrow B. As illustrated, the weld penetrates the planar member 10, which, can be a contact strip or the basewall of an electrically conductive can, the bimetal blade 40 and the center of the weld button 60.

In accordance with the present invention, in any switch design, the bimetal blade 40 is held in place by the preloaded weld button 60, and as such, the weld 70 serves to prevent relaxation of the pressure exerted by the weld button 60. In this regard, the weld can be either the illustrated resistance weld or an actual weld bead penetrating through a set of suitable apertures defined in the planar member 10 and the end 42 of the bimetal blade 40. As can be appreciated, the weld is configured, in a manner well known in the art, to prevent relaxation of the pressure. In other words the weld must be strong enough so that once the preload force B is removed, the weld button 60 continues to exert the necessary pressure against the end 42 of the blade 40 without failure of the weld 70.

Although a circular disc-like weld button is preferred, the weld button could also have a square or rectangular configuration. As can best be seen in FIG. 2, the cross-sectional area of the weld should be less than the bearing surface of the weld button. This would hold true for any configuration chosen for the weld button. In this regard, as a preferred embodiment, it has been found, that the ratio of the cross-sectional area of the weld to the bearing surface of the weld button should preferably be no more than about $\frac{1}{3}$. As such, the diameter of the weld 70 should preferably be no more than $\frac{1}{3}$ of the diameter of the weld button 60. By way of an example, the weld button can have a diameter of about 2.86 millimeters and the weld can have a diameter of about 0.762 millimeters.

While specific embodiments of the invention have been shown and described the invention should not be considered as so limited but only as limited as set forth in the appended claims.

I claim:

1. In a thermostatic switch of the type comprising:

a planar member; a fixed contact spaced from said planar member; means for mounting said planar member and said fixed contact so that said fixed contact faces towards said planar member; an elongated electrically conductive bimetal blade; means for connecting said bimetal blade, at one of its ends, to said planar member with the other of its ends freely extending towards said fixed contact; and a movable contact, connected to said other freely extending end of said bimetal blade so as to face towards said fixed contact; said bimetal blade adapted to flex from its said one attached end, in response to a temperature change from the ambient, between an unstressed and undeformed state and a stressed and deformed state, wherein in one such state said movable contact is spaced from said fixed contact and in the other such state, said movable contact is located against said fixed contact to respectively establish circuit open and closed conditions of said switch; the improvement comprising:

said bimetal blade connection means including, a preloaded weld button bearing against said one end of said bimetal blade in a press fit wherein the pressure exerted by said weld button on said one end of said bimetal blade prevents movement of said one end of bimetal blade relative to said weld button and said planar member to hold said bimetal blade in place; and a weld penetrating said planar member, said bimetal blade, and the center of said weld button, configured to prevent relaxation of the pressure exerted by said weld button, said weld having a cross-sectional area less than the area of the bearing surface of said weld button, whereby said one end of said bimetal blade is attached to said planar member essentially by the pressure exerted by said weld button rather than by said weld.

2. The thermostatic switch of claim 1 wherein the cross-sectional area of said weld is no greater than about $\frac{1}{3}$ of the area of the bearing surface of said weld button.

3. The thermostatic switch of claim 2 wherein:

said weld button has a circular disc-like configuration; and said weld has a diameter no greater than $\frac{1}{3}$ the diameter of said weld button.

4. The thermostatic switch of claim 3 wherein:

said weld button has a diameter of about 2.86 millimeters; and said weld has a diameter of about 0.762 millimeters.

* * * * *